US006046678A

United States Patent [19]

Wilk

[11] Patent Number: 6,046,678

[45] **Date of Patent: *Apr. 4, 2000**

[54] PROTECTIVE DEVICE FOR STORAGE AND TRANSPORT CONTAINERS

[76] Inventor: Peter J. Wilk, 185 W. End Ave., New York, N.Y. 10023

[ * ] Notice: This patent is subject to a terminal disclaimer.

[21] Appl. No.: 09/092,424

[22] Filed: Jun. 5, 1998

Related U.S. Application Data

[63] Continuation-in-part of application No. 08/878,321, Jun. 18, 1997, Pat. No. 5,835,012, and a continuation of application No. 08/303,082, Sep. 8, 1994, Pat. No. 5,528,228.

[51] Int. Cl.[7] ..... G08B 21/00

[52] U.S. Cl. ..... 340/686.1; 235/1 R; 235/132 E; 340/529; 340/571; 340/588; 340/689; 340/692

[58] Field of Search ..... 340/571, 689, 340/686.1, 588, 581, 539, 692, 669, 665, 521, 529; 235/132 E, 1 R

[56] References Cited

U.S. PATENT DOCUMENTS

| | | | |
|---|---|---|---|
| 3,798,672 | 3/1974 | Gregg, Jr. | 340/692 |
| 3,909,568 | 9/1975 | Greenhug | 200/61.45 R |
| 3,961,323 | 6/1976 | Hartkorn | 340/571 |
| 4,030,087 | 6/1977 | Ritchie et al. | 340/571 |
| 4,462,023 | 7/1984 | Nielsen et al. | 340/571 |
| 4,685,061 | 8/1987 | Whitaker | 701/35 |
| 4,688,244 | 8/1987 | Hannon et al. | 377/58 |
| 4,750,197 | 6/1988 | Denekamp et al. | 455/404 |
| 4,841,285 | 6/1989 | Laut | 340/571 |
| 5,027,105 | 6/1991 | Dailey et al. | 340/571 |
| 5,051,725 | 9/1991 | Caccitolo | 340/571 |
| 5,153,561 | 10/1992 | Johnson | 340/571 |
| 5,270,686 | 12/1993 | Martinez | 340/689 |
| 5,347,274 | 9/1994 | Hassett | 340/988 |
| 5,392,031 | 2/1995 | Toriumi et al. | 340/588 |
| 5,528,228 | 6/1996 | Wilk | 340/686.1 |
| 5,835,012 | 11/1998 | Wilk | 340/539 |

*Primary Examiner*—Glen Swann
*Attorney, Agent, or Firm*—R. Neil Sudol; Henry D. Coleman

[57] ABSTRACT

A protective device for storage and transport containers comprises, in accordance with the present invention, a housing or frame carrying a sensor for detecting orientation, an attachment element for securing the housing or frame to a container, an alarm mounted to the housing or frame and operatively coupled to the sensor for generating a cognizable alert signal upon detection by the sensor that the container is in an orientation other than a predetermined preferred orientation, and an activation element mounted to the housing or frame and operatively connected to the sensor and/or the alarm for enabling operation of that component after securing of the housing or frame to the container. The activation element preferably includes a switching component for enabling operation of the alarm only after securing of the housing or frame to the container.

21 Claims, 4 Drawing Sheets

PROTECTIVE DEVICE FOR STORAGE AND TRANSPORT CONTAINERS

CROSS-REFERENCE TO RELATED APPLICATIONS

This application is a continuation-in-part of application Ser. No. 08/878,321 filed Jun. 18, 1997, now U.S. Pat. No. 5,835,012.

BACKGROUND OF THE INVENTION

This invention relates mainly to a protective device for storage and transport containers. This invention also relates to an associated method for use in protecting contents of storage and transport containers.

A long standing problem in the shipping industry is damage to shipped goods. Containers holding fragile items are universally labeled with warnings such as "fragile" and "this side up." Despite such precautions, packages are nevertheless frequently subjected to treatment which damages their contents.

Besides impacts and misorientation, packages are sometimes subjected to other inordinately extreme conditions such as very low temperatures and severe jostling or shaking.

OBJECTS OF THE INVENTION

An object of the present invention is to provide a device attachable to a shipping container for aid in alleviating at least one of the above-mentioned conditions.

Another, more particular, object of the present invention is to provide such a device which assists in reducing the incidence of misorientation of packages during shipment and storage.

A further object of the present invention is to provide a device which can be used, for instance, by the insurance industry to at least partially determine treatment of a package during shipment.

Yet another object of the present invention is to provide an associated method for reducing the incidence of misorientation of packages during shipment and storage.

These and other objects of the present invention will be apparent from the drawings and detailed descriptions herein.

SUMMARY OF THE INVENTION

A protective device for storage and transport containers comprises, in accordance with the present invention, a housing or frame carrying a sensor for detecting orientation, an attachment element for securing the housing or frame to a container, an alarm mounted to the housing or frame and operatively coupled to the sensor for generating a cognizable alert signal upon detection by the sensor that the container is in an orientation other than a predetermined preferred orientation, and an activation element mounted to the housing or frame and operatively connected to the sensor and/or the alarm for enabling operation of that component after securing of the housing or frame to the container.

The activation element preferably includes a switching component for enabling operation of the alarm only after securing of the housing or frame to the container.

The alarm may include an electroacoustic transducer and means for reproducing a voice message. Such means may comprise, for example, (i) a memory component such as a recording tape or a solid state circuit and (ii) a speech reproduction unit such as an audio playback unit or digital-to-analog speech synthesis componentry.

A device in accordance with the present invention provides an additional stimulus or reminder to shipping personnel to right a misoriented package. Generally, it is contemplated that the alarm continues to sound until the container is placed in its preferred orientation.

An advantage of the present invention is that anybody may purchase the protective device and attach it to a container for a prepackaged shipment, without having to open the container. The attachment element is a permanent adhesive or other permanent coupling device (hooks, for example) which leaves a mark on the container should the protective device be removed.

According to another feature of the present invention, the device further comprises a timer mounted to the housing or frame and operatively connected to the sensor for measuring a time interval during which the container is in an orientation other than the preferred orientation. A memory mounted to the housing or frame is operatively connected to the timer for automatically storing the time interval in encoded form.

This feature of the invention provides a check on the care taken by the shipper. The device can be returned to the manufacturer, or the party attaching the protective device to the container, for determining the shipment history with regard to the orientation of the container and its contents. This shipment history information is valuable to insurers (including the manufacturer under warranty) for allocating responsibility and liability.

According to a further feature of the present invention, the device also comprises a mechanism and/or circuit operatively connected to the timer and the memory for deactivating the timer and for locking the memory to ensure integrity of contents of the memory upon a removal of the protective device from the container. This deactivation componentry may include a switch or circuit coupled to the attachment element or to the container itself.

This feature of the invention serves to prevent a shipper from removing the device from a shipping container and reprogramming the memory before the device is returned to the manufacturer. Generally, it is contemplated that the buyer or other receiver of the shipped goods removes the protective device and returns it to the manufacturer or the party responsible for attaching the protective device to the shipping container, for example, to an outer surface thereof. Of course, the sensor may also be deactivated so that it is inoperative during the return trip to the manufacturer.

According to an additional feature of the present invention, the device further comprises a detector mounted to the housing or frame of the protective device for measuring temperature. The alarm is operatively connected to the temperature detector for generating a cognizable indicator signal upon measurement of a temperature beyond a pre-established threshold. For example, if perishable food or temperature sensitive equipment is being shipped in the container, an alarm sounds when the temperature of the container rises beyond a predetermined maximum. If living organisms are being shipped, then an alarm will sound if the temperature of the container falls below a pre-established minimum.

According to a related feature of the invention, the timer is operatively connected to the temperature detector for measuring a time period during which the container is in a temperature range beyond the threshold, while the memory is operatively connected to the timer for automatically storing the time period in encoded form. Thus, a record of the temperature during shipment and storage is automatically generated, at least for insurance and quality control purposes.

In some cases, it may be desirable to have the recording capability without the alarm. Accordingly, a device for obtaining information pertaining to shipment histories comprises, in accordance with the present invention, a housing or frame, a sensor mounted to the housing or frame for detecting orientation, an attachment element for securing the sensor to a container, a timer mounted to the housing or frame and operatively connected to the sensor for measuring a time interval during which the container is in an orientation other than the preferred orientation, and a memory mounted to the housing or frame and operatively connected to the timer for automatically storing the time interval in encoded form.

A method for use in protecting contents of storage and transport containers comprises the steps of attaching a detector module to a storage and transport container and activating the detector module only after attaching of the detector module to the storage and transport container. After activating of the detector module, the detector module is operated to automatically and at least periodically detect orientation of the storage and transport container. Also after activating of the detector module, the detector module is further operated to automatically generate a cognizable alert signal when the container is in an orientation other than a predetermined preferred orientation.

In accordance with another feature of the present invention, the cognizable alert signal is generated by producing a sound wave via an electroacoustic transducer. The step of producing a sound wave may include the step of producing a voice message such as "Please straighten me out" or "Attention, attention, turn this box upright."

In accordance with a further feature of the present invention, the method also comprises the steps of (i) automatically measuring a time interval during which the container is in an orientation other than the preferred orientation and (ii) automatically storing (recording) the time interval in encoded form. Additional steps may include (iii) deactivating the timer and (iv) locking the memory to ensure integrity of contents of the memory upon a removal of the protective device from the storage and transport container.

In accordance with yet another feature of the present invention, the method further comprises the steps of automatically measuring temperature in the container and generating a cognizable indicator signal upon measurement of a temperature beyond a pre-established threshold. The time during which the container is in a temperature range beyond the threshold may be monitored and automatically recorded.

Other conditions of a container during shipment may be monitored and recorded. For example, the size and frequency of impacts may be monitored by a strain gauge network embedded in a flexible or resilient matrix and connected to an inertial mass also embedded in the matrix. The strain gauges are operatively connected to a monitoring circuit including a timer and a memory.

A protective device for storage and transport containers comprises, in accordance with the present invention, (a) a housing or frame carrying a sensor for detecting a physical condition of a predetermined kind, and (b) an attachment element for securing the housing or frame to a container. A timer mounted to the housing or frame is operatively connected to the sensor for determining that the detected physical condition has continued longer than a preselected duration. A wireless telecommunications transmitter mounted to the housing or frame is operatively connected to the timer for establishing a wireless telecommunications link to a predetermined remote receiver and transmitting, over the link to the receiver, a message that the detected physical condition has existed longer than the predetermined duration. An activation element is mounted to the housing or frame and is operatively connected to the sensor, the timer, and/or the transmitter so that a signal is possibly emitted only after securing of the housing or frame to the container.

Where the physical condition is orientation of the container, the sensor includes components for detecting that the container is in an orientation other than a predetermined preferred orientation. The timer is operatively connected to the sensor for measuring a time interval during which the container is in an orientation other than the preferred orientation. A memory may be operatively connected to the timer for automatically storing the time interval in encoded form. Where the physical condition is temperature, the sensor includes means for detecting that the container has a temperature beyond a predetermined threshold.

A method for use in protecting contents of storage and transport containers comprises steps of attaching a detector module to a storage and transport container, activating the detector module only after attaching of the detector module to the storage and transport container, and thereafter operating the detector module to automatically and at least periodically monitor the storage and transport container to detect whether the container has a pre-established physical condition. In the event that the container has the pre-established physical condition, the detector module is operated to automatically determine whether the container has had the pre-established physical condition for a time interval longer than a preselected duration. Upon a determination that the container has had the pre-established physical condition for a time interval longer than the preselected duration, the detector module is operated to establish a wireless telecommunications link to a predetermined remote receiver. Upon establishing of the link, the detector module is operated to transmit, over the link to the receiver, a message that the container has had the pre-established physical condition for a time interval longer than the preselected duration.

A device in accordance with the present invention provides an alarm signal to a remote location via a wireless telephone link in the event that a container with valuable contents is subjected to an undesirable and possibly damaging physical condition for longer than a prescribed period. Thus, the shipper, the addressee or other concerned party can take steps to trace the location or the container and/or alert responsible parties to rectify the undesirable situation. This procedure is in addition to providing a stimulus or reminder to shipping personnel at or about the location of the container to correct an unwanted condition of the container and its contents. Thus, the present invention serves as a supplement to the device and method described and claimed in U.S. Pat. No. 5,528,228.

The present invention is useful, for instance, where a container is placed in a cargo hold or other storage location which is not easily accessed by shipping, handling, or caretaker personnel. In such situations, even though an alarm may continue to be generated at the container for a substantial interval, the shipping, handling, or caretaker personnel may not be cognizant of the errant condition.

Other conditions of a container during shipment may be monitored and recorded. For example, the size and frequency of impacts may be monitored by a strain gauge network embedded in a flexible or resilient matrix and connected to an inertial mass also embedded in the matrix. The strain gauges are operatively connected to a monitoring circuit including a timer and a memory.

The present invention facilitates the use of a protective monitoring device in extended shipping and transport situations by permitting the installation of the protective monitoring device to a prepackaged container. This simplifies the use of a protective monitoring device and concomitantly enables use in a wider variety of applications. For example, ordinary consumers might use the device. Where a transmitter is included, a central facility may be established to serve as a clearing house for receiving and processing wireless signals for a multitude of users.

DETAILED DESCRIPTION

Figure 1:
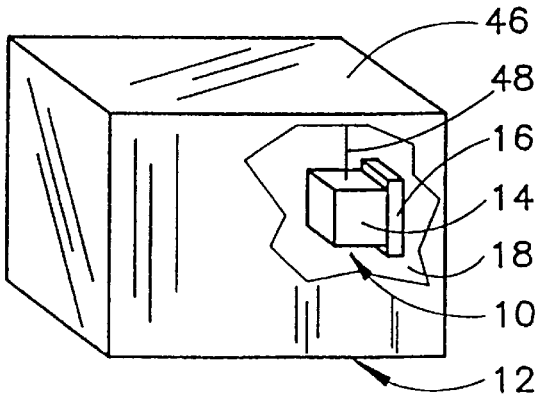
FIG. 1 is a schematic perspective view, on a reduced scale, of a protective device for storage and transport containers, showing disposition of the device in a shipping container.

As shown in FIG. 1, a protective device 10 for monitoring shipping conditions undergone by a storage and transport container 12 includes a housing or casing 14 attached via an adhesive layer 16, bolts (not shown) or other fastening elements to a side panel 18 of container 12.

Figure 2:
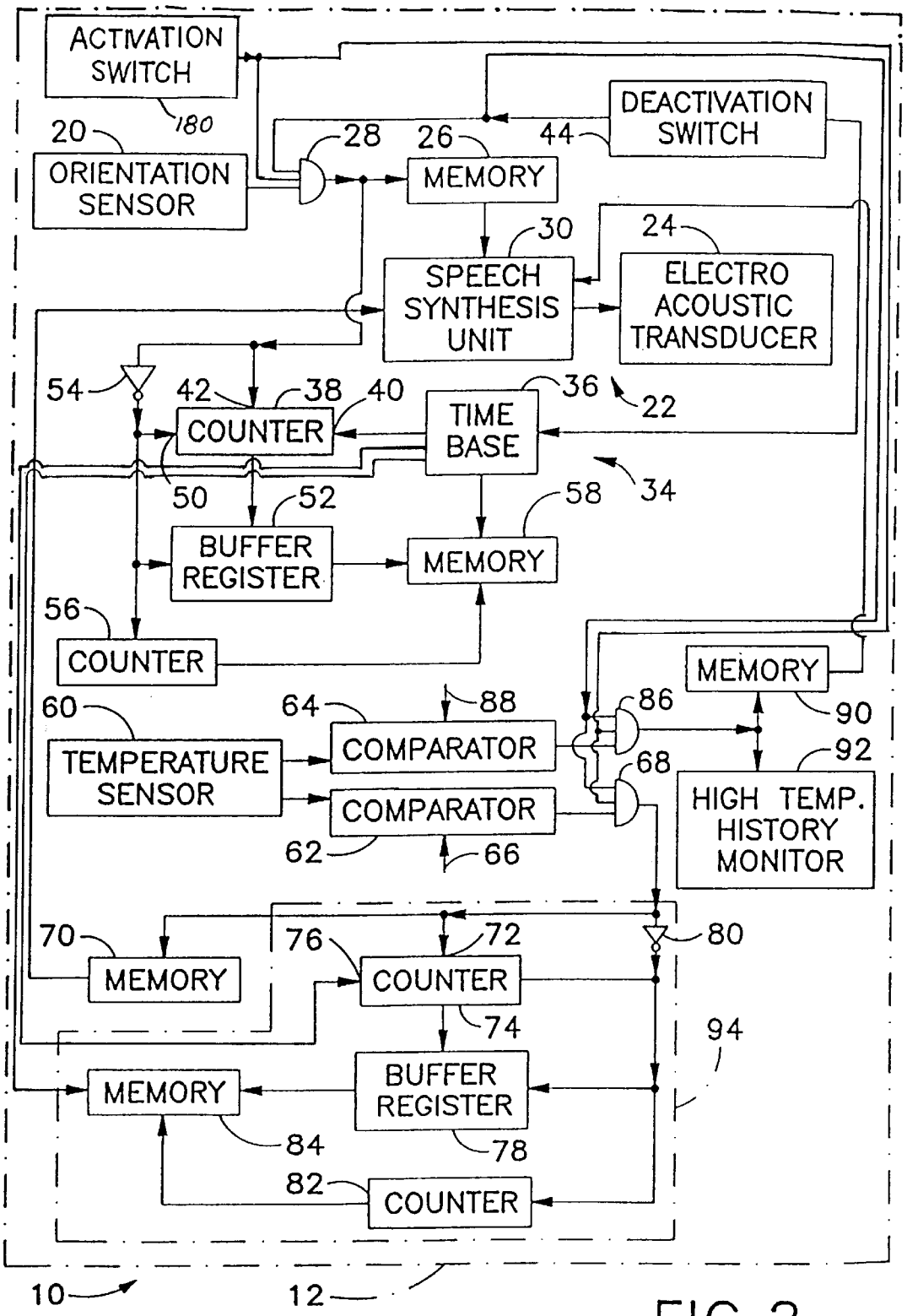
FIG. 2 is a block diagram of selected functional components of the protective device of FIG. 1, showing an activation switch for implementing an embodiment of the present invention shown in FIG. 6.

As illustrated in FIG. 2, protective device 10 comprises a sensor 20 for detecting orientation and alarm componentry 22 operatively coupled to the sensor for generating a cognizable alert signal upon detection by the sensor that the container is in an orientation other than a predetermined preferred orientation. Sensor 20 may incorporate a gravity switch (not separately shown) for detecting when container 12 is not in an upright orientation.

Alarm componentry 22 includes an electroacoustic transducer 24 and a solid state memory 26. Memory 26 stores at least one digitally encoded voice message such as "Box not in correct orientation," "Please place container in upright position," "I am on my side; please stand me up." Upon receiving an activation signal from sensor 20 via an AND gate 28, memory 26 transmits the digitally encoded warning or command to a speech synthesis unit 30. Speech sythesis unit 30 converts the digitally encoded voice message from memory 26 into an analog signal which is fed to an electroacoustic transducer 24 for acoustic reproduction.

Memory 26 and speech synthesis unit 30 may be replaced with an equivalent combination of elements such as a recording tape (not shown) and an audio playback unit (not shown).

The alarm componentry 22 of protective device 10 provides a stimulus or reminder to shipping personnel to right a misoriented package. Generally, it is contemplated that the alarm continues to sound until the container is placed in its preferred orientation.

As further illustrated in FIG. 2, device 10 also comprises a timer 34 including a time base 36 and a counter 38. Time base 36 generates a clock signal which is fed to an incrementing input 40 of counter 38 for measuring a time interval during which container 12 is in an orientation other than the upright orientation. The contents of counter 38 are incremented by the clock signal from time base 36 as long as an enabling input 42 of counter 38 is provided with a high logic signal. Counter input 42 is operatively connected to orientation sensor 20 via AND gate 28. Thus, counter 38 continues to measure time as long as orientation sensor 20 detects a misorientation of container 12 and as long as a de-activation switch 44 is transmitting a high logic signal to AND gate 28. Switch 44 changes its output to a low logic signal only upon the opening of container 12. To that end, switch 44 is connected to a lid 46 of container 12 via a wire 48 (FIG. 1).

Orientation sensor 20 is connected to a resetting input 50 of counter 38 and to an enabling input of a buffer register 52 via an inverter 54. Upon the righting of container 12 and a consequent reversion of the output of orientation sensor 20 to a low logic level from a high logic level, a high level logic signal from inverter 54 causes the contents of counter 38 to be transferred to buffer register 52 and induces the resetting of counter 38.

Inverter 54 is also connected to an incrementing input of a counter 56 which acts as an addressing and writing control for a solid state random access memory 58. Upon the incrementing of the contents of counter 56, the encoded time interval stored in buffer register 52 is transferred to an address location in memory 58 specified by the updated contents of counter 56. The time at which the loading of the encoded time interval into memory 58 occurs may also be stored in memory 58. This time is loaded from time base 36.

Thus, memory 58 contains an account or record of the intervals of misorientation of container 12. This record is terminated upon the opening of lid 46 and the consequent transmission of a low logic level disabling signal from switch 44 to AND gate 28. This diabling or deactivation signal effectively serves to lock memory 58.

Switch 44 may also be connected to time base 36 and at least indirectly to memory 58 for storing the time at which the container is opened. This time should correspond to the arrival of the container at the customer's lcoation.

The contents of memory 58 enable a manufacturer to check on the care taken by a shipper or carrier. Device 10 can be returned to the manufacturer for determining the shipment history with regard to the orientation of the container and its contents. This shipment history information may be used by insurers for allocating responsibility and liability.

As additionally illustrated in FIG. 2, device 10 further comprises a detector or sensor 60 for measuring temperature. Alarm componentry 22 is operatively connected to temperature sensor 60 for generating a cognizable indicator signal upon measurement of a temperature beyond a preestablished threshold. To implement that function, sensor 60 is connected at an output to a pair of comparators 62 and 64 which may be analog elements such as operational amplifiers. Upon a falling of the temperature of container 12 below a predetermined minimum threshold (encoded in an input signal 66 to comparator 62), comparator 62 generates a signal of a high logic level which is fed to an AND gate 68. Provided that switch 44 is not generating a disabling signal, AND gate 68 passes the high logic level signal from comparator 62 on to a solid state memory 70. Memory 70 is enabled by that high logic level signal to transmit a digitally encoded voice message to speech sythesis unit 30. The message may be, for example, the words "I am too cold; please turn up the heat," or "Temperature below minimum limit; please reset temperature."

AND gate 68 is also connected to an enabling input 72 of a counter 74 which has an incrementing input 76 connected to time base 36 for receiving the clock signal output thereof. Counter 74 has an output connected to a buffer register 78 for loading a measured time interval into the buffer register upon the detection by sensor 60 of a decrease in temperature beyond the pre-established minimum. Sensor 60 is connected to an enabling or writing input of buffer register 78 via an inverter 80, as well as via comparator 62 and AND gate 68. Upon the appearance of a high logic level signal at the output of inverter 80, the contents of counter 74 are transferred to register 78 and the counter is reset. In addition, inverter 80 is coupled to an address counter 82 which controls the location in a memory 84 at which the time interval from register 78 is stored. Memory 84 may also be connected to time base 36 for recording the time at which the interval of reduced temperature occurred.

As also illustrated in FIG. 2, comparator 64 is connected to an AND gate 86 which also receives an enabling signal from switch 44. Upon detecting a rise in temperature of container 12 beyond a maximum encoded in a signal 88, comparator 64 issues a high logic level signal to AND gate 86. Provided that switch 44 is not generating a disabling signal due to the opening of lid 46 (FIG. 1), a high level logic signal is transmitted from AND gate 86 to a voice message memory 90 for inducing that circuit element to transmit a digitally encoded voice message to speech synthesis unit 30. The message may be, for example, the words "I am too hot; please turn down the heat," or "Temperature above maximum limit; please reset temperature."

The high logic level signal from AND gate 86 may also be transmitted to a high temperature history monitoring circuit 92 including elements structurally identical to the elements of a low temperature history monitoring circuit 94. Those elements include counter 74, register 78, inverter 80, counter 82, and memory 84. Monitoring circuit 92 thus memorizes the durations of the time intervals during which container 12 experienced excessively high temperatures.

Figure 3:
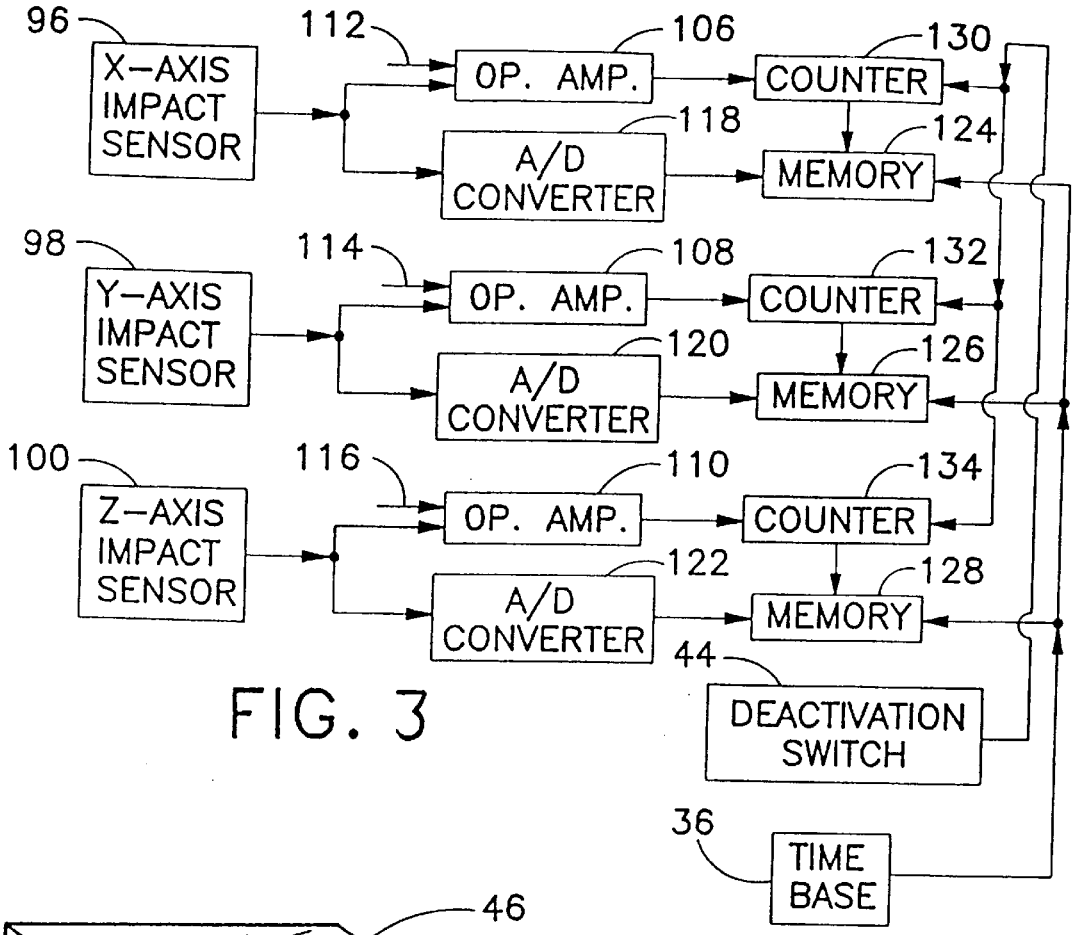
FIG. 3 is a block diagram of additional components optionally utilizable in the device of FIGS. 1 and 2.
Figure 4:
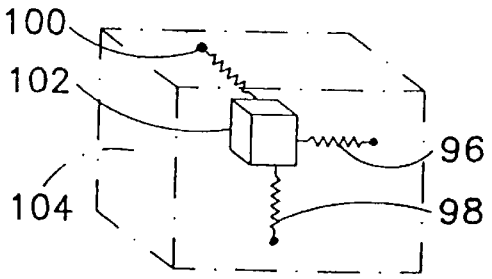
FIG. 4 is a schematic perspective view of a composite impact sensor utilizable in a device in accordance with the present invention.

As depicted in FIG. 3, device 10 may additionally comprise a plurality of impact sensors 96, 98 and 100 for detecting the sizes of impacts experienced by container 12 during shipment. As indicated in FIG. 4, sensors 96, 98 and 100 may take the form of respective strain gauges operatively connected to an inertial mass 102 and disposed together with the mass in a flexible or resilient medium 104 such as rubber.

As further depicted in FIG. 3, sensors 96, 98, and 100 are operatively connected to respective operational amplifiers or analog comparators 106, 108, and 110 which compare the outputs of the sensors with preset limits represented by signal inputs 112, 114, and 116. Sensors 96, 98, and 100 are also connected at their outputs to respective analog-to-digital converters 118, 120, and 122 which in turn are connected at their outputs to respective memories 124, 126, and 128. The digital output signals of converters 118, 120, and 122 are stored in memories 124, 126, and 128 at addresses determined by the contents of respective address counters 130, 132, and 134. The contents of counters 130, 132, and 134 are incremented upon the appearance of a high level logic signal at the outputs of operational amplifiers 106, 108, and 110.

Counters 130, 132, and 134 also control the writing process in memories 124, 126, and 128. Counters 130, 132, and 134 are disabled by a low-level logic signal from switch 44 upon the opening of container 12. This disabling prevents the writing of further impact information into memories 124, 126, and 128 and effectively locks the memories from erasure or further writing.

Time base 36 may be operatively connected to memories 124, 126, and 128 so that the times of the different impacts may be recorded.

Figure 5:
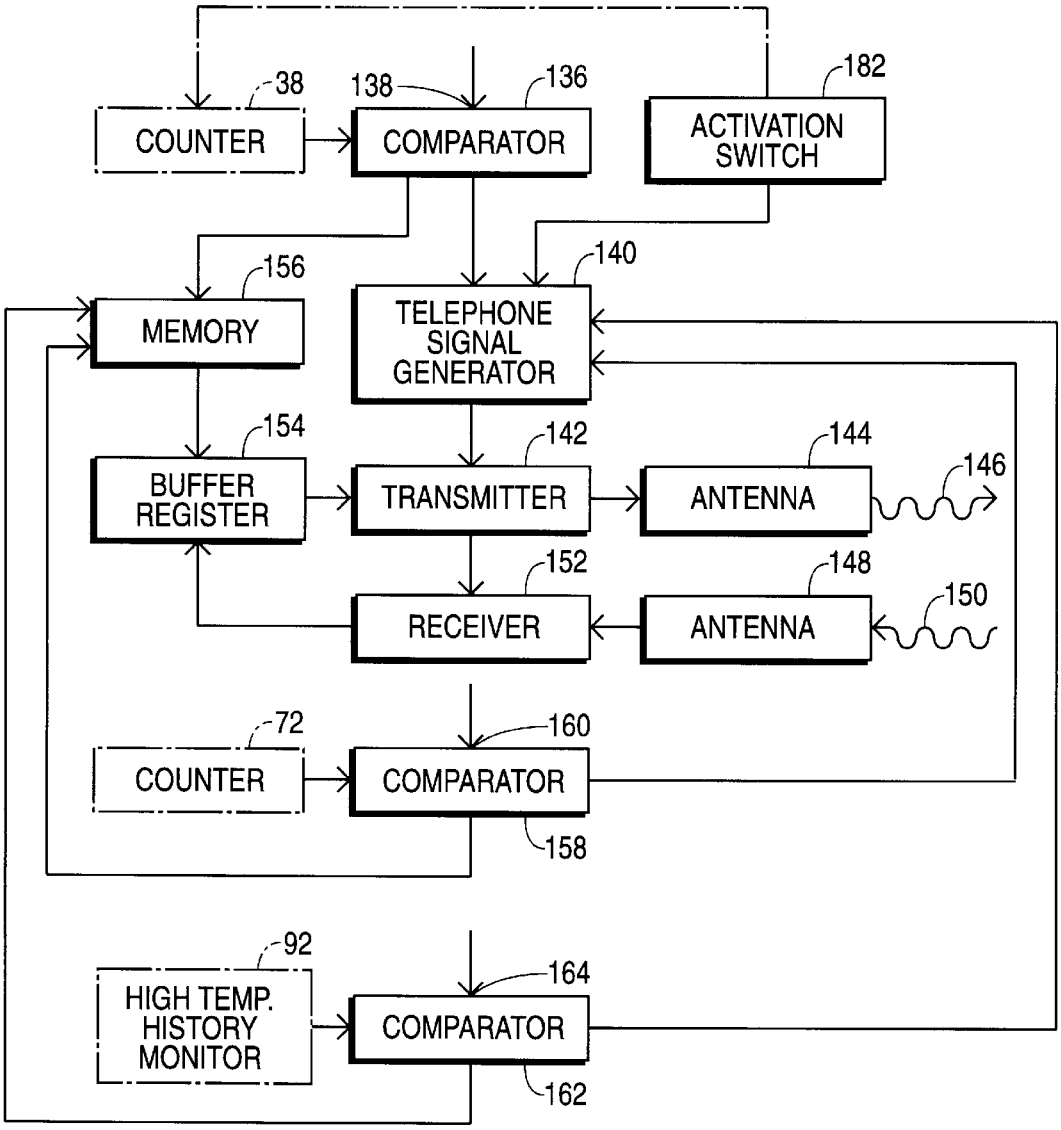
FIG. 5 is a block diagram of other components of the protective device of FIGS. 1 and 2, showing an activation switch for implementing an embodiment of the present invention shown in FIG. 6.

FIG. 5 depicts components of protective device 10 (FIGS. 1 and 2) for generating an alarm or a message at a remote location when container 12 (and the contents thereof) has had a physical condition of a prescribed type for longer than a prredetermined period. If that condition lasts for an extended period, damage may result to the contents of the container. Generally, the components of FIG. 5 serve as a back-up where an alarm generated at the container 12 has been ineffective to induce shipping, handling or caretaker personnel to rectify the undesired physical condition.

Counter 38 (FIG. 2) is connected at an output to a comparator 136 which has a second input 138 to which a signal representing a pre-established time interval is applied. Comparator 136 is coupled at an output to a telephone signal generator 140 of a type common in cellular telephones. Signal generator 140 produces a preprogrammed telephone signal which is amplified and otherwise prepared for long-distance transmission by a transmitter 142. The telephone signal from transmitter 142 is transmitted to a remote telephone station or computer via an antenna 144. The emitted signal 146, like conventional cellular telephone signals, may be reflected or relayed by a satellite.

Antenna 144 or, alternatively, a dedicated receiving antenna 148 picks up a confirmation signal 150 from the remote station. Confirmation signal 150 is detected by a receiver 152 which generates an enabling signal fed to a buffer register 154 for inducing the transmission of the contents of the buffer register to the remote telephone station or computer via transmitter 142 and antenna 144.

Comparator 136 has a second output which addresses a memory 156 to read out, to buffer register 154, a message that container 12 has been disposed in an undesired orientation for longer than the pre-established time interval encoded at the reference input 138 of comparator 136. This message preferably includes an identification of the particular container (and its contents), as well as a code for the type of undesired physical condition (misorientation), and may additionally identify the destination of the container and encode the duration of the undesired physical condition.

Emitted telephone signal 146 may be used by conventional triangulation or tracking technology to determine the precise geographic location of container 12. This geographic information may be useful in determining who is responsible for container 12, for example, where container 12 is transported by multiple shippers in seriatim.

As shown in FIG. 5, counter 72 (FIG. 2) is connected at an output to a comparator 158 which has an input 160 receiving a reference signal encoding a pre-established time interval. Upon determining that the output of counter 72 is equal to that pre-established time interval, comparator 158 issues a trigger signal to telephone signal generator 140 and a respective address signal to memory 156. In response to the address signal, memory 156 feeds to buffer register 154 a previously stored message. The message informs a person or computer at the remote telephone station that container 12 has had, for a time longer than the pre-established time interval encoded at the reference input 160 of comparator 158, a temperature lower than the predetermined minimum threshold encoded in the input signal 66 to comparator 62 (FIG. 2). This message includes an identification of the particular container (and its contents), as well as a code for the type of undesired physical condition (low temperature), and may additionally identify the destination of the container and encode the duration of the low temperature.

As further shown in FIG. 5, high-temperature history monitor 92 (FIG. 2) is connected at an output to a comparator 162 which has an input 164 receiving a reference signal encoding a pre-established time interval. Comparator 162 determines whether container 12 (and its contents) has had an impermissibly high temperature for longer than that pre-established time interval. If so, comparator 162 issues a trigger signal to telephone signal generator 140 and a respective address signal to memory 156. The trigger signal initiates the establishing of a long-distance telecommunications link, while the address signal induces memory 156 feeds to buffer register 154 a predetermined message. The message informs a person or computer at the remote telephone station that container 12 has had, for a time longer than the pre-established time interval encoded at the reference input 164 of comparator 158, a temperature higher than a predetermined maximum threshold.

It is to be noted that various refinements and optional capabilities may be provided for the functions described hereinabove with reference to FIG. 5. For example, history information pertaining to container 12 may be transmitted wirelessly via transmitter 142 and antenna 144, either upon the occurrence of an alarm condition, or periodically. Back-up telephone signalling codes may be provided in telephone signal generator 140, in the event that the first telephone station is busy. Alternatively, an automatic redialing feature may be provided.

Figure 6:
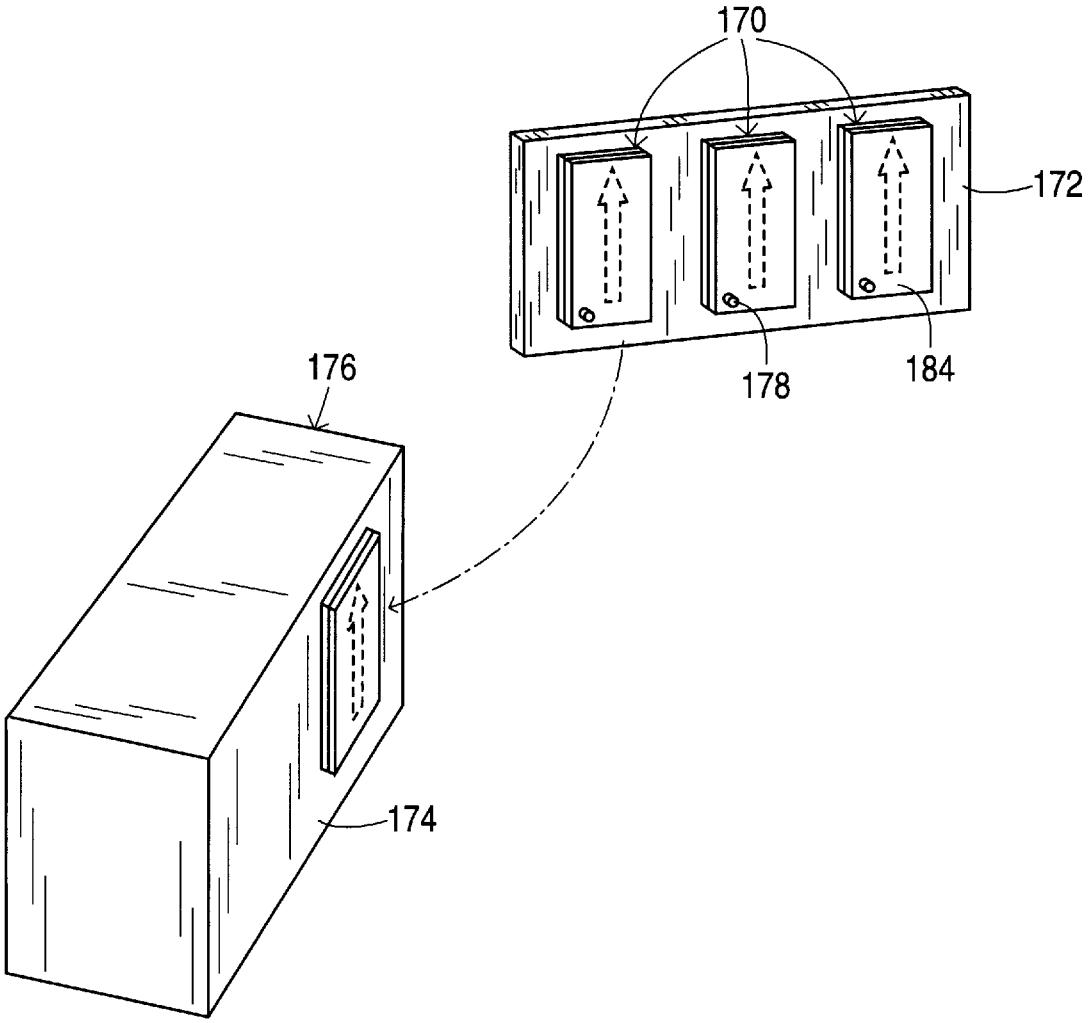
FIG. 6 is a schematic perspective view showing a plurality of protective monitoring devices in accordance with the present invention.

As illustrated in FIG. 6, a plurality of modular protective monitoring devices 170 are temporarily attached to a carrier 172. Carrier 172 is optional and is provided for convenience only. Devices 170 might alternatively be stacked in a box (not shown), for example.

Monitoring devices 170 have essentially the same capabilities and functions as the protective transport and storage devices discussed above, except that monitoring devices 170 have a dormant state, wherein their monitoring, recording and alarm functions are disabled or inactive prior to use of the devices. Obviously, there is no need to monitor physical shipping conditions such as orientation, temperature, impacts, etc., while the monitoring devices 170 are themselves in transport on carrier 172 (or in a box) to an end user.

Monitoring devices 170 are removed from carrier 172 and attached as needed to outer surfaces 174 of respective storage and transport containers 176. Upon the attachment of monitoring devices 170 to storage and transport containers 176, the devices are activated to perform their intended functions of detecting undesired changes in orientation and undesired changes in temperature, as well as impacts and other changes in physical condition.

To enable activation of monitoring devices 170, the devices may be provided with a pushbutton 178 or other switch mechanism, for example, one that is actuated by the securing of the respective monitoring device 170 to a surface. Pushbutton or mechanism 178 is operatively connected to an electrical activation switch 180 (FIG. 2) or 182 (FIG. 5). Activation switch 180 produces a logic signal which blocks output from AND gates 28, 68, and 86 until the state of the activation switch is changed by operation of pushbutton or switch mechanism 178. Similarly, activation switch 182 produces a signal which prevents the incrementation of counter 38 (FIG. 5) or the production of a telephone signal by generator 140 and the concomitant transmission of a signal via transmitter 142. Like activation switch 180, switch 182 may be operatively connected to orientation sensor 20 (via AND gate 28) or temperature sensor 60 (via AND gates 68 and 86) for disabling the operation of those sensors until the respective monitoring device 170 is called into use.

Monitoring devices 170 each include a housing or frame represented in FIG. 1 by reference designation 12 and in FIG. 6 by reference designation 184. The various components of the monitoring devices, shown in FIG. 2 or alternatively FIG. 5, are mounted to frames 12 and 184. Frames 12 and 184 are provided with an attachment element such as a layer of adhesive for securing the frames or housings to surfaces 174 of storage and transport containers 176.

It is to be noted that deactivation switch 44 may be designed for operation upon a forcible removal of the respective monitoring device 170 from a surface.

Although the invention has been described in terms of particular embodiments and applications, one of ordinary skill in the art, in light of this teaching, can generate additional embodiments and modifications without departing from the spirit of or exceeding the scope of the claimed invention. It is to be noted, for instance, that the recording of time intervals of unsafe storage or shipping conditions may be implemented merely by storing the times that the intervals begin and the times at which they end. The durations may be computed subsequently from the time data.

Accordingly, it is to be understood that the drawings and descriptions herein are profferred by way of example to facilitate comprehension of the invention and should not be construed to limit the scope thereof.

What is claimed is:

1. A protective device for storage and transport containers, comprising:

a housing or frame;

a sensor mounted to said housing or frame for detecting orientation;

attachment means for securing said housing or frame to a container so that said housing or frame has a preferred orientation with respect to gravity;

an alarm mounted to said housing or frame and operatively coupled to said sensor for generating a cognizable alert signal upon detection by said sensor that the container is in an orientation other than a predetermined preferred orientation;

an activation element mounted to said housing or frame and operatively coupled to at least one of said sensor and said alarm for enabling operation of said one of said sensor and said alarm after securing of said housing or frame to said container; and a timer mounted to said housing or frame and operatively connected to said sensor for measuring a time interval during which said housing or frame and concomitantly the container are in an orientation other than said preferred orientation, also comprising a memory operatively connected to said timer for automatically storing said time interval in encoded form.

2. The device defined in claim 1 wherein said activation element includes a switching component for enabling operation of said alarm only after securing of said housing or frame to said container.

3. The device defined in claim 2 wherein said alarm further includes means for reproducing an audible verbal message.

4. The device defined in claim 1, further comprising a temperature detector mounted to said housing or frame for measuring temperature, said alarm being operatively connected to said detector for generating a cognizable indicator signal upon measurement of a temperature beyond a pre-established threshold.

5. A device for obtaining information pertaining to shipment histories, comprising:

a housing or frame;

attachment means for securing said housing or frame to a container so that said housing or frame has a preferred orientation with respective to gravity;

a sensor mounted to said housing or frame for detecting orientation;

a timer mounted to said housing or frame and operatively connected to said sensor for measuring a time interval during which the container is in an orientation other than a predetermined orientation;

a memory mounted to said housing or frame and operatively connected to said timer for automatically storing said time interval in encoded form; and an activation element mounted to said housing or frame and operatively coupled to at least one of said sensor, said timer and said memory for enabling operation of said one of said sensor, said timer and said memory only after securing of said housing or frame to said container.

6. The device defined in claim 5, further comprising a detector mounted to said housing or frame for measuring temperature, said timer being operatively connected to said detector for measuring a time period during which the container is in a temperature range beyond a predetermined threshold, said memory being operatively connected to said timer for automatically storing said time period in encoded form.

7. A method for use in protecting contents of storage and transport containers, comprising the steps of:

attaching a detector module to a storage and transport container;

activating said detector module only after attaching of said detector module to said storage and transport container;

after activating of said detector module, operating said detector module to automatically and at least periodically detect orientation of said storage and transport container;

after activating of said detector module, further operating said detector module to automatically generate a cognizable alert signal when the container is in an orientation other than a predetermined preferred orientation;

operating said detector module to automatically measure a time interval during which the container is in an orientation other than said preferred orientation; and automatically storing said time interval in encoded form.

8. The method defined in claim 7 wherein said step of further operating includes producing an audible verbal message.

9. The method defined in claim 7, further comprising the additional steps of operating said detector module to automatically measure temperature and generate a cognizable indicator signal upon measurement of a temperature beyond a pre-established threshold.

10. The method defined in claim 9, further comprising operating said detector module to measure a time period during which the measured temperature is in a temperature range beyond said threshold and automatically store said time period in encoded form.

11. A protective device for storage and transport containers, comprising:

a housing or frame;

a sensor mounted to said housing or frame for detecting a physical condition of a predetermined kind attachment means for securing said housing or frame to a container;

a timer mounted to said housing or frame and operatively connected to said sensor for determining that the detected physical condition has continued longer than a preselected duration;

a wireless telecommunications transmitter mounted to said housing or frame and operatively connected to said timer for establishing a wireless telecommunications link to a predetermined remote receiver and transmitting, over said link to said receiver, a message that said detected physical condition has existed longer than said predetermined duration; and an activation element mounted to said housing or frame and operatively coupled to at least one of said sensor, said timer, and said transmitter for enabling said one of said sensor, said timer, and said transmitter only after securing of said housing or frame to said container.

12. The device defined in claim 11 wherein said physical condition is orientation, said sensor including components for detecting that the container is in an orientation other than a predetermined preferred orientation.

13. The device defined in claim 12 wherein said timer is operatively connected to said sensor for measuring a time interval during which the container is in an orientation other than said preferred orientation, also comprising a memory operatively connected to said timer for automatically storing said time interval in encoded form.

14. The device defined in claim 11 wherein said physical condition is temperature, said sensor including means for detecting that the container has a temperature beyond a predetermined threshold.

15. The device defined in claim 14 wherein said timer is operatively connected to said sensor for measuring a time period during which the container is in a temperature range beyond said threshold, also comprising a memory operatively connected to said timer for automatically storing said time period in encoded form.

16. A method for use in protecting contents of storage and transport containers, comprising:

attaching a detector module to a storage and transport container;

activating said detector module only after attaching of said detector module to said storage and transport container;

after activating of said detector module, operating said detector module to automatically and at least periodically monitor the storage and transport container to detect whether the container has a pre-established physical condition;

in the event that the container has the pre-established physical condition, operating said detector module to automatically determine whether the container has had the pre-established physical condition for a time interval longer than a preselected duration;

upon determining that the container has had the pre-established physical condition for a time interval longer than said preselected duration, operating said detector module to establish a wireless telecommunications link to a predetermined remote receiver; and upon the establishing of said link, operating said detector module to transmit, over said link to said receiver, a message that the container has had the pre-established physical condition for a time interval longer than said preselected duration.

17. The method defined in claim 16 wherein said physical condition is an orientation other than a predetermined preferred orientation, the monitoring of said container including detecting that the container is in an orientation other than said preferred orientation.

18. The method defined in claim 17, further comprising operating said detector module to automatically measure a time interval during which the container is in an orientation other than said preferred orientation, also comprising operating said detector module to automatically store said time interval in encoded form in a memory.

19. The method defined in claim 16 wherein said physical condition is a temperature beyond a predetermined threshold, the monitoring of said container including detecting that the container has a temperature in a range beyond said predetermined threshold.

20. The method defined in claim 19, further comprising operating said detector module to automatically measure a time period during which the container is in a temperature range beyond said threshold, also comprising operating said detector module to automatically store said time period in encoded form in a memory.

21. The method defined in claim 16, further comprising operating said detector module to automatically generate an alarm signal cognizable within a region about said container, upon detecting that the container has said pre-established physical condition.

* * * * *